United States Patent [19]

Stamper

[11] 4,317,242

[45] Mar. 2, 1982

[54] DEVICE FOR THE REMOVAL OF FOUL AIR FROM TOILET BOWLS AND THE LIKE

[76] Inventor: Robin H. Stamper, 1891 Westborne Rd., Bryanston, Transvaal Province, South Africa

[21] Appl. No.: 80,014

[22] Filed: Sep. 28, 1979

[30] Foreign Application Priority Data

Sep. 29, 1978 [ZA] South Africa ..... 78/5539

[51] Int. Cl.[3] ..... E03D 9/04

[52] U.S. Cl. ..... 4/213; 4/217

[58] Field of Search ..... 4/213, 217, 253, 251, 4/236, 237, 234

[56] References Cited

U.S. PATENT DOCUMENTS

| | | | |
|---|---|---|---|
| 735,927 | 8/1903 | Woodruff | 4/253 |
| 1,736,467 | 11/1929 | Sarrett | 4/213 |
| 1,774,156 | 8/1930 | Root | 4/213 X |
| 1,793,815 | 2/1931 | McCann | 4/253 |
| 2,001,593 | 5/1935 | Tector | 4/213 |
| 2,009,054 | 7/1935 | Mooney | 4/213 |
| 2,017,590 | 10/1935 | Duffner | 4/213 |
| 2,238,461 | 4/1941 | Carman | 4/213 |
| 2,558,578 | 6/1951 | Palmieri | 4/253 |
| 2,747,201 | 5/1956 | Herriott | 4/213 |
| 2,846,696 | 8/1958 | Herriott | 4/213 |
| 3,059,244 | 10/1962 | Jarrett | 4/213 |
| 3,332,089 | 7/1967 | Wilton | 4/213 |
| 3,593,349 | 7/1971 | Bungo | 4/237 |
| 3,600,724 | 8/1971 | Stamper | 4/217 |
| 3,659,296 | 5/1972 | Stamper | 4/217 |
| 3,869,737 | 3/1975 | Stevenson | 4/213 |
| 3,887,948 | 6/1975 | Stamper | 4/213 |
| 4,099,047 | 7/1978 | Kirkland, Jr. | 4/213 |

FOREIGN PATENT DOCUMENTS

| | | | |
|---|---|---|---|
| 464068 | 4/1972 | Australia | 4/213 |
| 1814988 | 4/1960 | Fed. Rep. of Germany | 4/213 |
| 1962891 | 4/1967 | Fed. Rep. of Germany | 4/213 |
| 2145726 | 9/1971 | Fed. Rep. of Germany | 4/213 |
| 387561 | 3/1963 | France | 4/213 |
| 210956 | 11/1940 | Switzerland | 4/213 |
| 387561 | 3/1965 | Switzerland | 4/213 |
| 1450418 | 9/1976 | United Kingdom | 4/213 |

*Primary Examiner*—Henry K. Artis

[57] ABSTRACT

The invention concerns a device for the removal of foul air from toilet bowls or the like. The device comprises a conduit having an inlet opening and at least one outlet opening spaced from the inlet opening. The conduit has a hook shape and is capable of hooking over the rim of the toilet bowl and under the seat so that the inlet opening is within the bowl and the outlet opening is outside the bowl. The device also includes an air treatment means within the conduit, capable of improving the quality of foul air passing through it. The device also includes a battery-operable fan capable of drawing foul air out of the bowl via the inlet opening, along the conduit, through the air treatment means and out of the outlet opening. The air treatment means, optionally together with the battery, may be provided as a replaceable pack. A securing means, e.g. in the form of a strap, may pass through the device and be of a length to fit around the bowl. A lock can be provided on the strap. A resilient seal may be supplied for attachment to the underside of the seat.

6 Claims, 10 Drawing Figures

DEVICE FOR THE REMOVAL OF FOUL AIR FROM TOILET BOWLS AND THE LIKE

This invention relates to a device for the removal of foul air or for the improvement of the quality of air from toilet bowls, or the like.

Devices of which the applicant is aware, require skilled labour and special tools to install. Such prior art devices of which the applicant is aware, require adaptations or alterations to either one or more of the following:

the plumbing, the hardware, electrical wiring, the masonry or the removal of the seat.

It is an object of the present invention to provide a device or a kit which can easily be fitted to existing toilet bowls by an average householder, without requiring special skills, tools, or equipment.

Accordingly, for a toilet bowl having a rim and a seat supportable on the rim with a space between the seat and the rim, the invention provides a device for removing and/or treating foul air from the toilet bowl and comprising a conduit having an inlet opening and at least one outlet opening spaced from the inlet opening, said conduit having a hook shape adapted to hook over the rim under the seat such that the inlet opening is disposed within the bowl, and the outlet opening is disposed outside the bowl;

air treatment means within the conduit and adapted to improve the quality of foul air passing therethrough; and a battery-operable fan adapted to draw foul air out of the bowl via the inlet opening, and to pass it along the conduit through the air treatment means and out of the outlet opening.

The device provided by the invention may be operable by means of a single small battery.

In use, the inlet opening may be directed downwardly inside the rim of the bowl when the hook-shaped conduit is hooked over the rim. In cross section, the conduit should be of substantially greater horizontal width than vertical depth, hereinafter referred to as being of 'rectangular' section where it passes over the rim. The cross-sectional area of the 'rectangular section', even if it has curved edges, should be a least two square centimeters, but is preferably about five square centimeters. The ratio of width to depth of the rectangular section may be at least 2:1. Preferably the ratio is about 5:1, but it could be 20:1.

The volumetric capacity of the fan may be at least thirty liters per minute, but preferably is about sixty liters per minute.

The air treatment means may include a replaceable or throw-away pack of activated carbon or charcoal, the pack having a shape to fit into a recess in the conduit to receive it. The volume of activated carbon may be at least one hundred cubic centimeters, but preferably is about one hundred and fifty cubic centimeters. The cross-sectional area of the pack available for air flow may be at least forty square centimeters, but preferably is about eighty square centimeters. The length of the air path through the pack may be at least one and a half centimeters but preferably is about two and a half centimeters.

The replaceable pack may include a battery for energizing the fan. The amount of activated carbon can, if desired, be such that when the battery is exhausted, its odour-altering property of said substance is substantially exhausted as well. There may be a switch which is operable to energize the fan. The switch may be a pressure-sensitive switch provided in that portion of the conduit between the seat and the rim, the switch being operable by pressure on it when a person sits on the seat to energize the fan, and being biassed to de-energize the fan when a person no longer sits on the seat. Leads may be provided from the battery, the leads having connectors capable of connecting with the leads from the switch and the fan. The connectors may be press-fit connectors, push-fit connectors, strip connectors along the inside of the conduit, etc.

The fan may be capable of generating in the conduit a pressure of about 40 kPa (0.15 inches water gauge).

The invention extends also to a do-it-yourself toilet bowl ventilation kit comprising a device as described above, and a resilient seal of urine-resistant material, the seal conveniently having a pressure-sensitive adhesive face to permit fixing to the underside of the seat in such a manner as to close off the space on either side of the conduit between the seat and the rim and between the seat buffers, when the seat is in its lowered position on the rim.

According to another aspect of the invention, in a toilet bowl having a rim and seat supportable on the rim with a space between the seat and the rim, the method of modifying a toilet bowl and seat combination for improving the quality of foul air emanating from the toilet bowl during use, which includes the steps of suspending a device over the rim of the bowl such that the inlet opening is inside the bowl and the outlet opening is outside it; and securing a resilient sealing strip to the underside of the seat to seal off the space on either side of the device where it passes over the rim of the bowl, and between the seat and the rim when the seat is in its lowered position on the rim.

The fan may comprise an electrical motor having a drive shaft on which may be mounted one or more blades capable of causing the displacement of air as the shaft rotates. The fan may be surrounded by a sound insulating material, eg a plastics foam. The foam may form a wall of the passageway through which air has to pass and will be of a closed cell type or air proof type of material.

The seal may be of any suitable shape which slopes downwards when the seat is raised, eg of triangular, T-shaped section, or of 7-shaped cross section. The seal can be of a peripheral length to leave room only for the hook-shaped portion of the conduit to pass between opposite ends of the seal where the hook-shape passes over the rim. The seal may adhere to the toilet seat. For example, the seal may be provided with a pressure-sensitive layer which is exposed by removing a protective strip.

In an alternative cross-section, the seal may have an elongated foot shape attachable to the underside of the toilet seat, and a downwardly depending leg at the lower part of the seat when the seat is in its raised position. The leg can extend from approximately the centre of the foot to a point approximately below one end of the foot. The angles between the base of the foot and its edges conveniently are different. When attached to the underside of the seat, with the leg points outwardly from the bowl, when the seat is in its lowered position. This avoids or reduces the possibility of urine collecting between the leg and the foot of the seal.

The seal may be an extrusion of a plastics material. It may be marked to indicate which side is intended to form the inner periphery and which side is intended to form the outer periphery when attached to the underside of the seat. It may be a closed cell foam construction of triangular cross section greater than one centimeter sides but less than three centimeter sides and with at least two sides flexibly urethane coated with a third side self adhesively coated.

In use, the seal can be compressed to up to one quarter of its normal thickness under a pressure of about 5 Kg but will normally compress just sufficiently to create air tight sealing right around the bowl. The seal and the device provided by the invention do not interfere with the mechanics of the seat. For example, no unscrewing of the seat or its buffers need take place. Skilled labour is not required for fitting the device.

The conduit may be moulded from any suitable plastics material. Alternately, it may be of metal construction and electroplated or dipped in a durable plastics finish which may be baked thereafter. It may also be made of stainless steel.

The invention will now be described by way of example with reference to the accompanying drawings.

Figure 1:
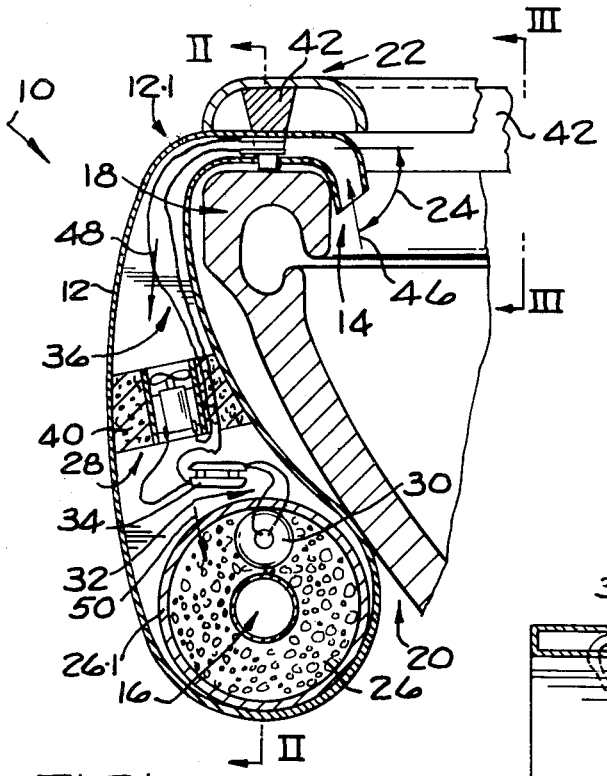
FIG. 1 shows a sectional front elevation of one embodiment of the invention in position on the side of a toilet bowl.

Referring to the drawings, reference numeral 10 refers generally to a device according to the invention. It comprises a conduit 12 having an inlet opening 14 and an outlet opening 16 longitudinally spaced from the inlet opening 14. The conduit has a hook-shape, generally indicated by reference numeral 12.1 which is adapted to hook over the rim 18 of a toilet bowl, generally indicated by reference numeral 20. The hook-shape portion of the conduit passes over the rim 18 and under the seat 22, such that the inlet opening 14 is disposed within the rim of the bowl, and the outlet opening is disposed outside it. The horizontal part of the conduit 12 is of rectangular cross section. In a modification (not illustrated) the conduit 12 may be telescopic so it can be extended and contracted horizontally. The inlet opening 14 is directed downwardly within the rim of the bowl so that the angle indicated by reference numeral 24, is at least 15 degrees. Due to the shape indicated, it is difficult for urine to enter the inlet opening 14. A strap 25 having a lock (not shown) passes around the toilet bowl 20 and through the openings 16 to make unauthorised removal of the device more difficult.

The device further comprises air-treatment means, generally indicated by reference numeral 26, upstream of the outlet opening 16. The air-treatment means is adapted to improve the quality of foul air passing therethrough. The device further comprises a battery-operable fan, generally indicated by reference numeral 28, which is located downstream of the inlet opening, and which is adapted to draw foul air out of the bowl 20 via the inlet opening, and to pass it along conduit 12, through the air-treatment means 26, and out of the outlet opening 16.

The conduit, where it passes over the rim 18 of the bowl 20, is of rectangular section. The conduit is made of metal or a synthetic plastics material. Resilient spacing material may be provided beneath that part of the conduit which fits over the rim of the bowl. The cross-sectional area of the conduit in the hook portion 12.1, is about 5 square centimeters. It has a depth of about one centimeter, and is about 5 centimeters wide. The volumetric capacity of the fan is 60 liters per minute. The air-treatment means 26 is in the form of a hollow cylindrical pack 26.1 shaped to fit into the lower end of the conduit. The volume of the activated carbon in the pack 26.1 is about 150 cubic centimeters. The surface area of the pack available for air flow is about 60 square centimeters. The length of the air path through the pack is at least 2 centimeters. Incorporated within the pack there is a dry cell battery 30 having leads 32 leading to connecting means 34 from which leads 36 lead to the fan motor 28 and to a switch 38. Instead of leads, contactors may be in electrical communication with strip conductors (e.g. aluminium foil) along the inside surface of the conduit 12. If desired, the conduit 12 may be hinged adjacent the position marked by the arrow 12.1 in FIG. 1. The fan motor 28 is mounted in an opening provided in a resiliently flexible partition 40 of closed cell synthetic plastics foam. Stabilising arms 41, 41.1 rest against the side of the curved bowl 20 to limit movement of the device with respect to the bowl. Alternatively, resilient spacing material may be provided.

Figure 3:
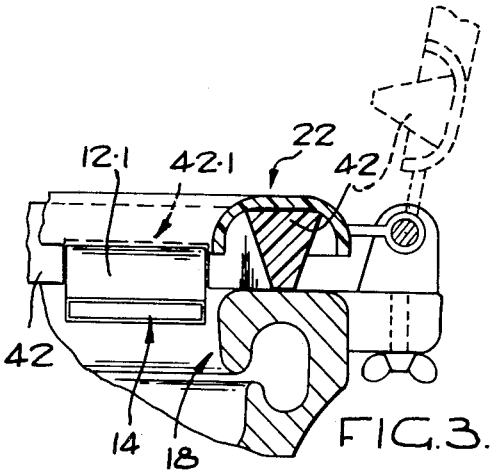
FIG. 3 shows a part-sectional side elevation of the toilet bowl taken at III—III in FIG. 1.

Referring to FIG. 3 of the drawings, the seat 22 is shown in broken lines in the raised position. On the underside of the seat there is provided a seal 42 of roughly triangular shape extending up to the hook shape 12.1 The seal has a rebated region 42.1 over the hook-shape part 12.1 of the conduit 12. From FIG. 3 it will be seen that when the seat is in the raised position, the seal 42 has its sides so disposed that any liquid dropping on it from above, will flow around it and down along its underside.

Figure 4:
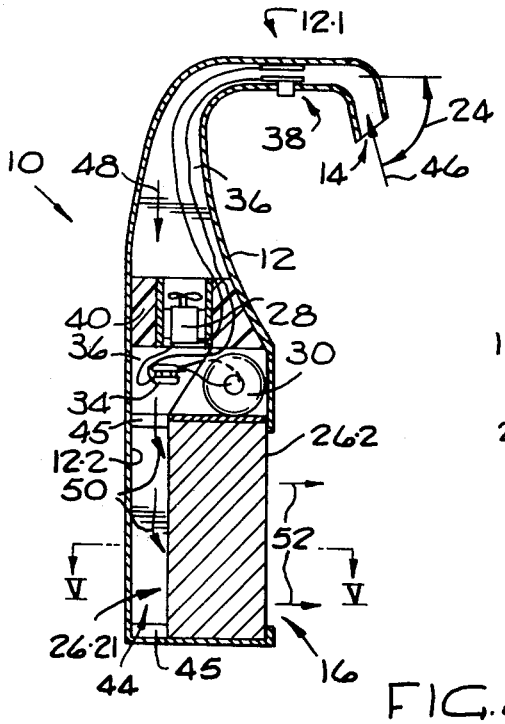
FIG. 4 shows a sectional front elevation of another embodiment of the device.
Figure 5:
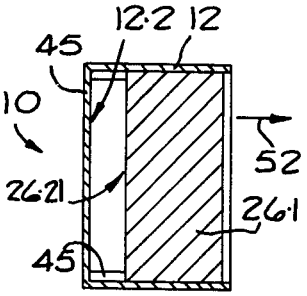
FIG. 5 shows a sectional plan view taken at V—V in FIG. 4.

Referring now to FIGS. 4 and 5 of the drawings, there is shown an alternative construction, in which the air-treatment means is in the form of a rectangular box-like pack 26.2 instead of a hollow cylindrical pack-shape 26.1. The pack also includes a battery as well as leads 32, connectors 34, and leads 36. In other respects the construction is similar to that described for FIGS. 1 to 3. The back face 26.21 of the pack 26.2 is spaced away from the inner surface 12.2 of the casing 12, thereby to provide a cavity 44. If desired, the horizontal dimensions may be decreased, and the vertical dimensions increased to give a more aesthetic appearance.

In use, air will flow into the inlet opening as indicated by arrow 46, through the goose-neck portion 12.1 of the duct, then downwardly as indicated by arrow 48 through the fan, and then down into and through the filter pack 26.1 and 26.2 as indicated by arrows 50. The air finally passes out of the filter pack 26.2, as indicated by arrows 52. The spacing of the rear face 26.21 of the filter pack 26.2 from the rear face 12.2 of the casing 12, is provided by ribs 45 extending from the rear face 12.2.

Figure 6:
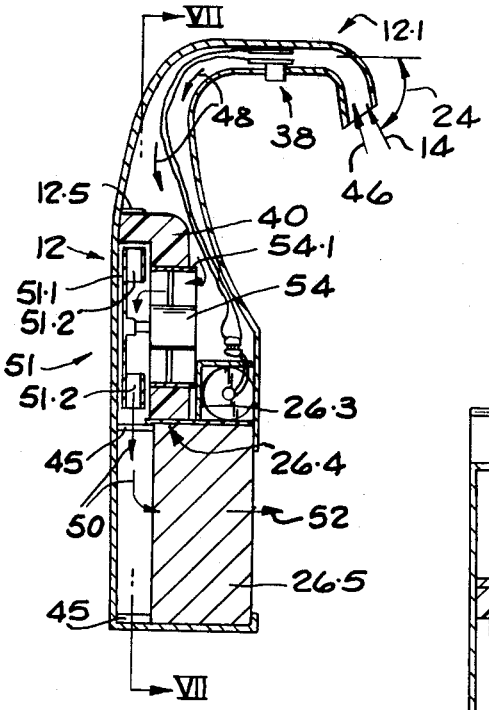
FIG. 6 shows a sectional side elevation of yet another embodiment of the device, making use of a centrifugal fan instead of an axial flow fan.
Figure 7:
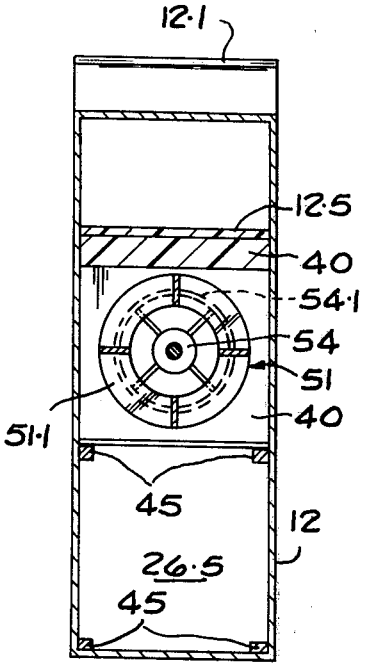
FIG. 7 shows a sectional side elevation taken at VII—VII.

Referring now to FIGS. 6 and 7 of the drawings, there is shown an embodiment which is similar in construction to that shown in FIGS. 4 and 5, except that instead of an axial flow fan 28, there is provided a centrifugal fan 51. The fan has an impeller 51.1 having vanes 51.2. Motor 54 for this fan is mounted in a conduit 54.1 which in turn is mounted in an aperture provided in a resiliently flexible synthetic plastics foam partition 40 which is of a closed cell structure. The casing 12 is provided with a shoulder 12.5 against which the upper end of the partition 40 abuts when located in position. The lower end of the partition 40 is located in position by a shoulder 26.3, and the upper surface 26.4 of the replaceable pack 26.5.

The advantage of using a centrifugal fan is that a fairly low speed motor can be used whereas for an axial flow fan a fairly high speed motor is required. A low speed motor is less expensive than a high speed motor.

Figure 2:
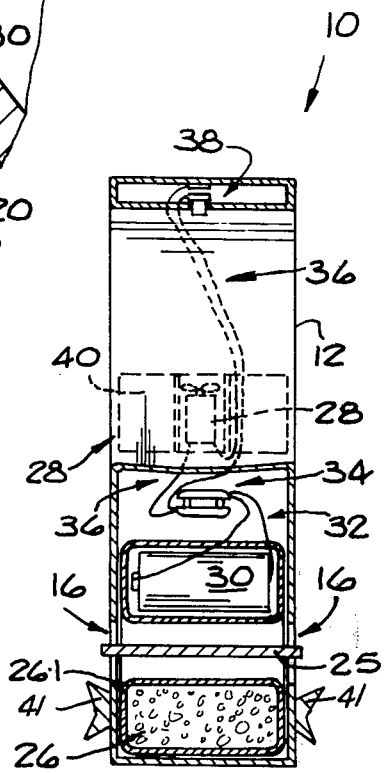
FIG. 2 shows a sectional elevation taken at II—II of the device of FIG. 1 (but removed from the toilet bowl)
Figure 8:
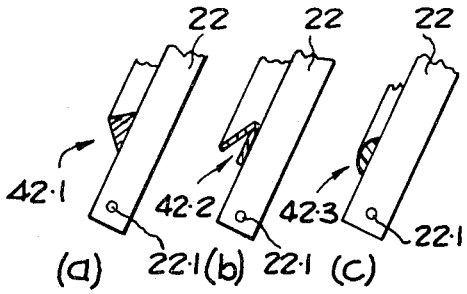
FIG. 8 shows diagrammatically various cross-sectional profiles of seals attached to the underside of a toilet seat.

Referring now to FIG. 8 of the drawings, seats 22 are shown diagrammatically in the raised position. The seats are adapted to pivot about the pivotal axes 22.1. Various alternative types of seals are shown at the lower ends of the seats 22. The types of seals shown are suitable for attachment to seats having flat undersurfaces. The various seals 42.1, 42.2 and 42.3 are shown. The triangular type of seal is very suitable for attachment to seats having flat undersurfaces. But then they will have a smaller height than those use for seats having a curved undersection as shown in FIGS. 1 and 3. When the seat is raised, the upper surface of the seal points downwardly. This is advantageous as any urine can run into the bowl.

Figure 9:
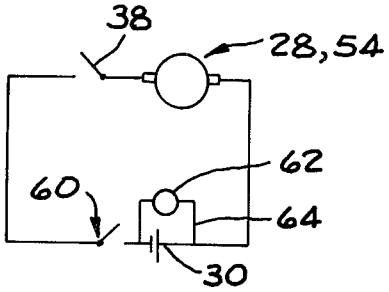
FIG. 9 shows a circuit diagram of the electrical circuitry.

Referring now to FIG. 9 of the drawings, there is shown a schematic diagram of electrical circuitry of the device. Reference numeral 38 refers to the switch operable when a person sits on the seat 22. The fan motor is indicated by reference numerals 28 and 54. Reference numeral 60 refers to a main switch which is in series with the switch 38 and which is operable to isolate the motor entirely when desired. Reference numeral 62 indicates a battery condition indicator, which is energizable via a switch 64 when it is desired to see the condition of the battery. The battery condition indicator 62 or volt meter may be fitted to the side of the casing 12, as indicated in FIG. 7 of the drawings.

Figure 10:
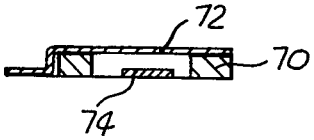
FIG. 10 is a cross section through a suitable switch for use with the invention.

The switch shown in FIG. 10 comprises an annular compressible polystyrene ring 70 having a strip 72 of aluminium tape extending across the ring as one terminal. A further strip 74 of aluminium tape forms the other terminal. When a person's weight presses down on the ring 70, it distorts to permit the two strips 72, 74 to make electrical contact with each other. When pressure is removed, the ring 70 returns to the shape shown.

The applicant has found that in order to be effective to remove foul air from a toilet bowl for treatment, it is necessary that the fan must have the capacity stated above, and that the device must have the various dimensions mentioned. The purpose is to provide an inflow of air into the bowl while it is in use. If there is an outflow of air while the bowl is in use, then air treatment will not be efficient.

The system relies on the human frame to seal off most of the area over the seat, for its total effectiveness. The inflow must not be too much otherwise there is an unwanted cooling effect. The preferred fan capacity is believed to provide adequate ventilation without undue cooling.

The applicant has found that devices made in accordance with the instructions set out above, and as illustrated can easily be applied to most toilet seats and toilet pans and will work effectively when so applied. It will be appreciated that no structural alterations need to be made to existing toilet towl installations as the device hangs from the rim of a toilet bowl between the seat and the bowl.

The seal 42 may conveniently be of ethylene vinyl acetate which is resistant to oil, solvents and chemicals, and is also weather-resistant and waterproof. It can be made to be highly compressible, and is of closed cell construction. It can also be made to have an outer skin. It is preferred for a seal when it has an outer skin. When supplied as part of a kit, a length is supplied and a pressure-sensitive adhesive face is covered by a removable protective covering. The length of seal is then cut to required sizes and secured to the underside of the seat, leaving a gap on either side of the hook-shape 12.1 of the device and a gap between the seat buffers.

The button of the switch 38 on the hook shaped duct 12.1 preferably uses a stiff spring or resilient cushion so that the device will preferably hang only from the button of the switch or from the cushion. The stiffness of the spring or cushion will conveniently be such as to be able to support up to about five kilograms pressure or mass. When the device hangs in this manner its mass is such that the middle part of the hook-shaped duct 12.1 is in fact roughly horizontal. When the seat and lid are in the downward position and touching the top of the conduit 12.1, the device will still hang from the cushion or from the button of the switch. This will still be the case when articles such as towels or small objects up to about say three kilograms in mass are placed on the lid.

Only when a pressure or mass in excess of five kilograms is applied to the seat will the switch button move to make contact and to start the device, while at the same time allowing the bottom of the goose neck to seal against the rim of the bowl under pressure of the seat seating against the top of the hook-shaped duct 12.1.

In order to prevent theft or unauthorized removal, the device may incorporate securing means for securing it around the lower thin section or stem of the bowl so as to permit its unhooking but not its removal. The securing means may be in the form of a wire strap which passes through an opening especially made in the casing for this purpose, or through the opening 16 and capable of being locked therein. (See FIGS. 1 and 2 of the drawings).

The switch shown in FIG. 10 may be provided with a coating of adhesive plastics material to enable it to be attached to an inner or outer surface of the conduit. The adhesive material conveniently also protects the switch from air, water, etc., in a hygenic manner. The switch is inconspicuous and occupies a very small area of an interior or exterior wall of the conduit. When on the underneath exterior wall of the conduit, the complete device can be supported on the switch.

In use, the underside of a seat is provided with a seal as described, leaving a gap to permit the device to hook over the rim of the bowl. Thereupon, upon a person sitting on the seat, the switch 38 will close and air will be drawn out of the bowl by the device. This will cause a nett air inflow into the bowl over the seat at the back and between the person's legs. Foul air will therefore be drawn out of the bowl and will be passed through the air-treatment means and will be deodorised there.

The positioning of the seal on the underside of the seat may be determined by drawing pencil lines when the seal is down, to define the thickness of the rim. The seal may then be fixed to the underside of the seat between the pencil lines.

I claim:

1. For use in a toilet bowl having a rim and a seat supportable on the rim with a space between the seat and the rim, the improvement of having a device for removing foul air from the toilet bowl, said device comprising a conduit having an inlet opening and at least one outlet opening spaced from the inlet opening, said conduit having a hook shape adapted to hook over and be suspended from the toilet bowl rim under the seat such that the inlet opening is disposed within the bowl, and the outlet opening is disposed outside the bowl;

a pressure sensitive switch member projecting downwardly through the underside of the conduit between the inlet and the outlet, said switch member being the fulcrum by which the device hangs from the toilet bowl rim, said switch member being in the open position when pressure is not applied to the seat;

air treatment means within the conduit and adapted to improve the quality of foul air passing therethrough;

a battery-operable fan adapted to draw foul air out of the bowl via the inlet opening, and to pass it along the conduit through the air treatment means and out of the outlet opening;

electrical leads connecting the switch member, the fan and the battery to provide an electrical path between the switch member, fan and battery when pressure is applied to the seat causing the conduit to be lowered towards the rim of the toilet bowl and thereby causing the switch member to be in the closed position; and securing means extending from the conduit and passing around the toilet bowl for securing the conduit to the toilet bowl in a manner to prevent unauthorised removal.

2. A device as claimed in claim 1, wherein the end of the hook shape which points downwarly into the bowl has the inlet opening in the said end whereby air entering the inlet passes vertically upwardly.

3. A device as claimed in claim 1, wherein the air treatment means is of annular shape and wherein the securing means comprises a strap and a lock extending through the annulus from the device, the strap being of a length to fit around the toilet bowl and be locked by the lock.

4. In a toilet bowl having a rim and a seat supportable on the rim with a space between the seat and the rim, the method of modifying the toilet bowl and seat combination for improving the quality of foul air emanating from the toilet bowl during use, which includes the steps of (i) suspending a device over the rim of the bowl, said device comprising a conduit having an inlet opening and at least one outlet opening spaced from the inlet opening, said device having a hook shape enabling it to hook over and be suspended from the toilet bowl rim and under the seat such that the inlet opening is disposed within the bowl and the outlet opening is disposed outside the bowl;

a pressure sensitive switch member projecting downwardly through the underside of the conduit between the inlet and outlet, said switch member being the fulcrum by which the device hangs from the toilet bowl rim, said switch member being in the open position when no pressure is applied to the seat;

air treatment means within the conduit and adapted to improve the quality of foul air passing therethrough;

a battery-operable fan adapted to draw foul air out of the bowl via the inlet opening, and to pass it along the conduit through the air treatment means and out of the outlet opening;

electrical leads connecting the switch member, fan and battery to provide an electrical path therebetween when the switch member is closed by pressure applied to the toilet seat; and (ii) securing a resilient sealing strip to the underside of the seat to seal off the space on either side of the device where the device passes over the rim of the bowl, said space being around the rim and between the seat and the rim when the seat is in the lowered position; and (iii) passing a strap or the like securing means from the device around the bowl and locking the securing means to prevent unauthorised removal of the device from the bowl.

5. A do-it-yourself toilet bowl ventilation kit comprising a pack including (i) a device comprising a conduit having an inlet opening and at least one outlet opening spaced from the inlet opening, said conduit having a hook shape adapted to hook oer and be suspended from the toilet bowl rim under the seat such that the inlet opening is disposed within the bowl, and the outlet opening is disposed outside the bowl;

a pressure sensitive switch member projecting downwardly through the underside of the conduit between the inlet and outlet ends, said switch member being the fulcrum by which the device hangs from the toilet bowl rim, said switch member being in the open position when no pressure is applied to the seat;

air treatment means within the conduit and adapted to improve the quality of foul air passing therethrough;

a battery-operable fan adapted to draw foul air out of the bowl via the inlet opening, and to pass it along the conduit through the air treatment means and out of the outlet opening; and electrical leads connecting the switch member, fan and battery to provide an electrical path therebetween when pressure is applied to the toilet seat;

(ii) a resilient seal of urine-resistant material, said seal having a pressure-sensitive face for attachment to the underside of the seat, said seal being of a length to close off the space on either side of the conduit between the toilet seat and the rim of the bowl;

(iii) a securing means extending from the device and being of a size adapted to pass round the toilet bowl, said securing means device including locking means for removably locking the device to the toilet bowl to prevent unauthorised removal thereof; and (iv) fixing instructions for enabling the kit to be used.

6. A device as claimed in claim 1, wherein the end of the hook shape which points downwardly into the bowl has the inlet opening in the said end whereby air entering the inlet passes vertically upwardly and wherein the fan is surrounded by a sound insulating material forming a wall of the passageway through which air has to pass downwardly towards the air treatment means.

* * * * *